United States Patent [19]

Neuhierl

[11] 3,935,664

[45] Feb. 3, 1976

[54] CONNECTOR ARRANGEMENT FOR DETACHABLE FASTENING OF AIRPLANE WINGS TO THE FUSELAGE OF MODEL AIRPLANE

[76] Inventor: Hermann Neuhierl, Waldstrasse 36, 8510 Furth, Bayern, Germany

[22] Filed: May 2, 1975

[21] Appl. No.: 573,995

[30] Foreign Application Priority Data

May 3, 1974 Germany ..... 2421418

[52] U.S. Cl. ..... 46/76 R; 244/120; 244/131

[51] Int. Cl.[2] ..... A63H 27/02; B64C 1/26

[58] Field of Search ..... 244/117 R, 119, 120, 124, 244/131; 46/76 R, 76 A, 77, 78, 79, 80, 81; 403/348, 353

[56] References Cited

UNITED STATES PATENTS

| | | | |
|---|---|---|---|
| 6,451 | 5/1849 | Brooke | 403/348 |
| 2,542,042 | 2/1951 | McCoy | 46/76 R |
| 2,915,762 | 12/1959 | Kivela | 403/348 |
| 3,017,137 | 1/1962 | Helmke et al. | 244/120 |
| 3,177,612 | 4/1965 | Giossi | 46/81 |
| 3,640,491 | 2/1972 | Harrison | 244/131 |

FOREIGN PATENTS OR APPLICATIONS

| | | | |
|---|---|---|---|
| 1,026,519 | 4/1953 | France | 403/353 |

*Primary Examiner*—Trygve M. Blix
*Assistant Examiner*—Galen L. Barefoot
*Attorney, Agent, or Firm*—Haseltine, Lake & Waters

[57] ABSTRACT

A connector arrangement for the detachable fastening of airplane wings to the fuselages of model airplanes. The arrangement utilizes generally tongue and groove-like T-shaped connector elements, which are connected to each other within the fuselage, or to a constructional element located therein, by a rubber band under pretensioning. These tongue and groove-like connector elements are adapted to be swivelled or rotated in their extended positions, and may then come into contact with an intermediate member or the outer surface of the fuselage, and are maintained in their rotated positions. In this position, the tongue and groove-like connector element, upon attachment of the airplane wing, may be positioned in a cutout formed in the end surface of the wing.

2 Claims, 6 Drawing Figures

CONNECTOR ARRANGEMENT FOR DETACHABLE FASTENING OF AIRPLANE WINGS TO THE FUSELAGE OF MODEL AIRPLANE

FIELD OF THE INVENTION

The present invention relates to a connector arrangement for the detachable fastening of airplane wings to the fuselages of model airplanes.

In model airplanes of intermediate and large dimensions, both halves of the airplane wings are normally constructed so as to be removable from the fuselage. This measure is absolutely necessary for reasons of transportation, as well as for packing or shipping.

DISCUSSION OF THE PRIOR ART

Inasmuch as the model airplanes are preferably flown with the use of remote radio control, and also in breezy weather, or are employed in simulated flight, a relatively high stress load is produced at the connecting locations between the wings and the fuselage. A construction is known, in which the airplane wings are connected with the fuselage by means of steel pins. Two steel pins are placed in tubes or sleeves which are located at suitable distances within the wings, as well as in the fuselage. It is thus also necessary to tension the wings inwardly towards the fuselage. For this purpose, a method is known in which a rubber band is pulled through the fuselage through the use of a wire or cord. On both sides of the fuselage, this rubber band is then hooked into open eye rings which are located on the end surface of each airplane wing.

This known method frequently requires a lot of patience, since only limited accessibility is available, and the rubber band must somehow be hooked and threaded in under tension.

SUMMARY OF THE INVENTION

Accordingly, it is an object of the present invention to provide a construction for the connection of airplane wings to the fuselage of a model airplane which avoids the disadvantages encountered in the prior art.

For this purpose, the present invention utilizes generally tongue and groove-like T-shaped connector elements, which are connected to each other within the fuselage, or to a constructional element located therein, by means of a rubber band under pretensioning. These tongue and groove-like connector elements are adapted to be swivelled or rotated in their extended positions, and may then come into contact with an intermediate member or the outer surface of the fuselage, and are maintained in their rotated positions. In this position, the tongue and groove-like connector element, upon attachment of the airplane wing, may be positioned in a cutout formed in the end surface of the wing. Subsequently, in a simple manner, either manually or by means of a tool, there is again effected a rotational or swivelling movement through an angle of about 90°. The tongue and groove-like connector element now locks against the inner side of the airplane wing end surface, and is pulled inwardly against the fuselage by means of the rubber band, so that the wing surface is pressed against the side wall of the fuselage. It has been necessary that the back-facing portion of the tongue and groove-like connector element interiorly of the fuselage be shaped rectangularly or otherwise, however, in no instance circular, so that this portion of the tongue and groove-like connector element finds room in the fuselage, but after rotation swivelling through about 90°, is supported against the side surface of the fuselage and retained in this rotated position. The connection of the fuselage and airplane wings, by means of this method, is effected completely without any problems, and may also be carried out under difficult circumstances, for example, at an absence of adequate lighting.

BRIEF DESCRIPTION OF THE DRAWINGS

Reference may now be had to the following detailed description of an embodiment of the invention, taken in conjunction with the accompanying drawings; in which.

DETAILED DESCRIPTION

Figure 1:
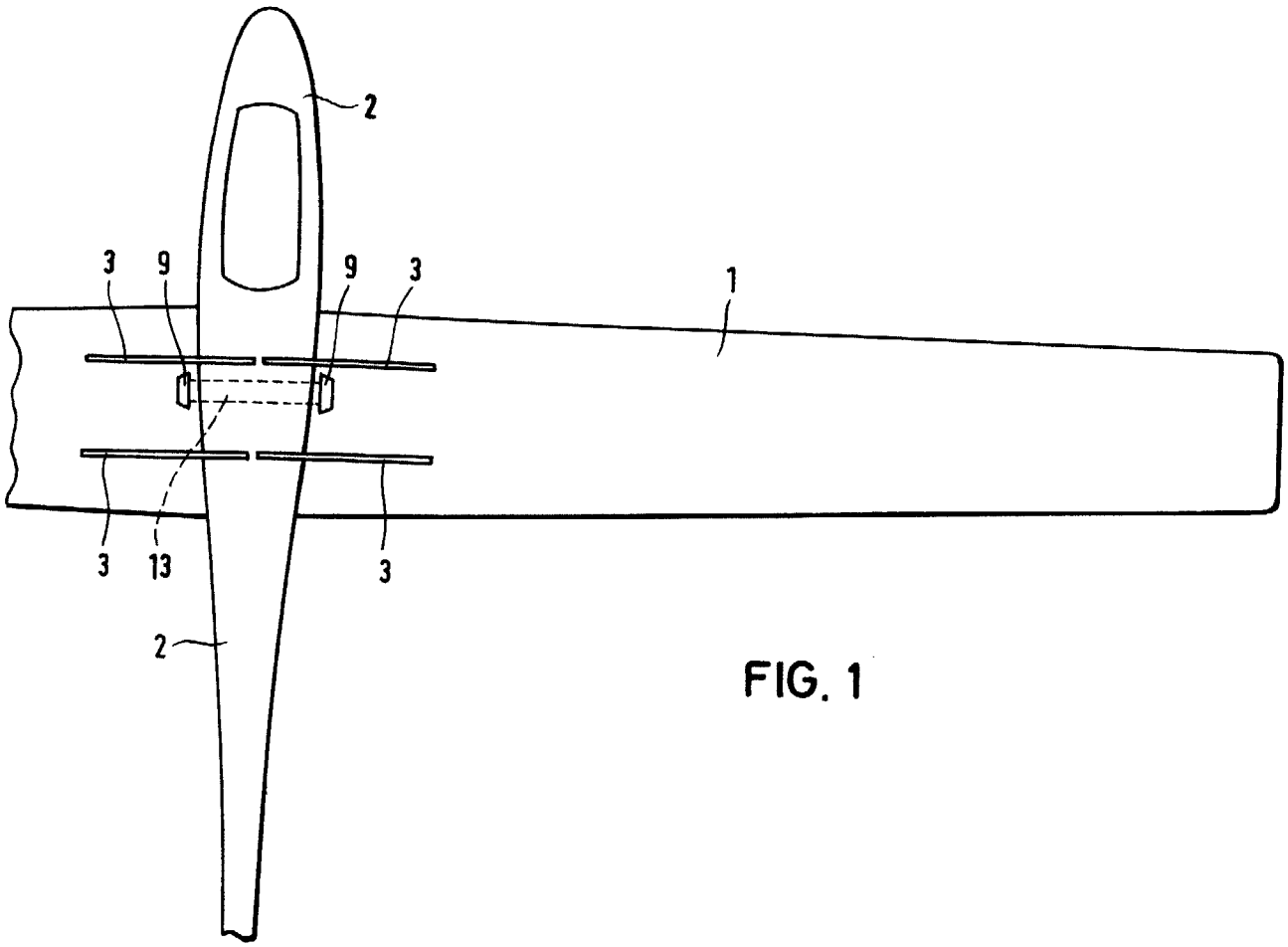
FIG. 1 schematically illustrates, partly in section, a plan view of a model airplane.

In accordance with FIG. 1 of the drawings, the fuselage of the aircraft is designated by reference numeral 2, and the airplane wings by reference numeral 1. As may be ascertained from FIG. 2, and shown schematically in FIG. 1, as if transparent, the airplane wings 1 are connected with the fuselage 2 by means of metallic connector pins 3, and oriented in their positions. The pins 3 are guided in sleeves 4 in the fuselage 2 and in corresponding sleeves (not shown) in the airplane wings 1. The pins may be fastened in one of the sleeves 4 in the fuselage 2 or in the airplane wings 1, or may be loose, but positioned in closely-fitted relationship in the sleeves. The airplane wings 1 are maintained with their end surfaces 31 (FIG. 3) against the fuselage 2 in a pressed position by means of the connector elements 9, as is schematically shown in FIG. 1, are connected with each other through a pretensioned rubber band 13, and are tensioned in the direction towards the interior of the fuselage.

Figure 2:
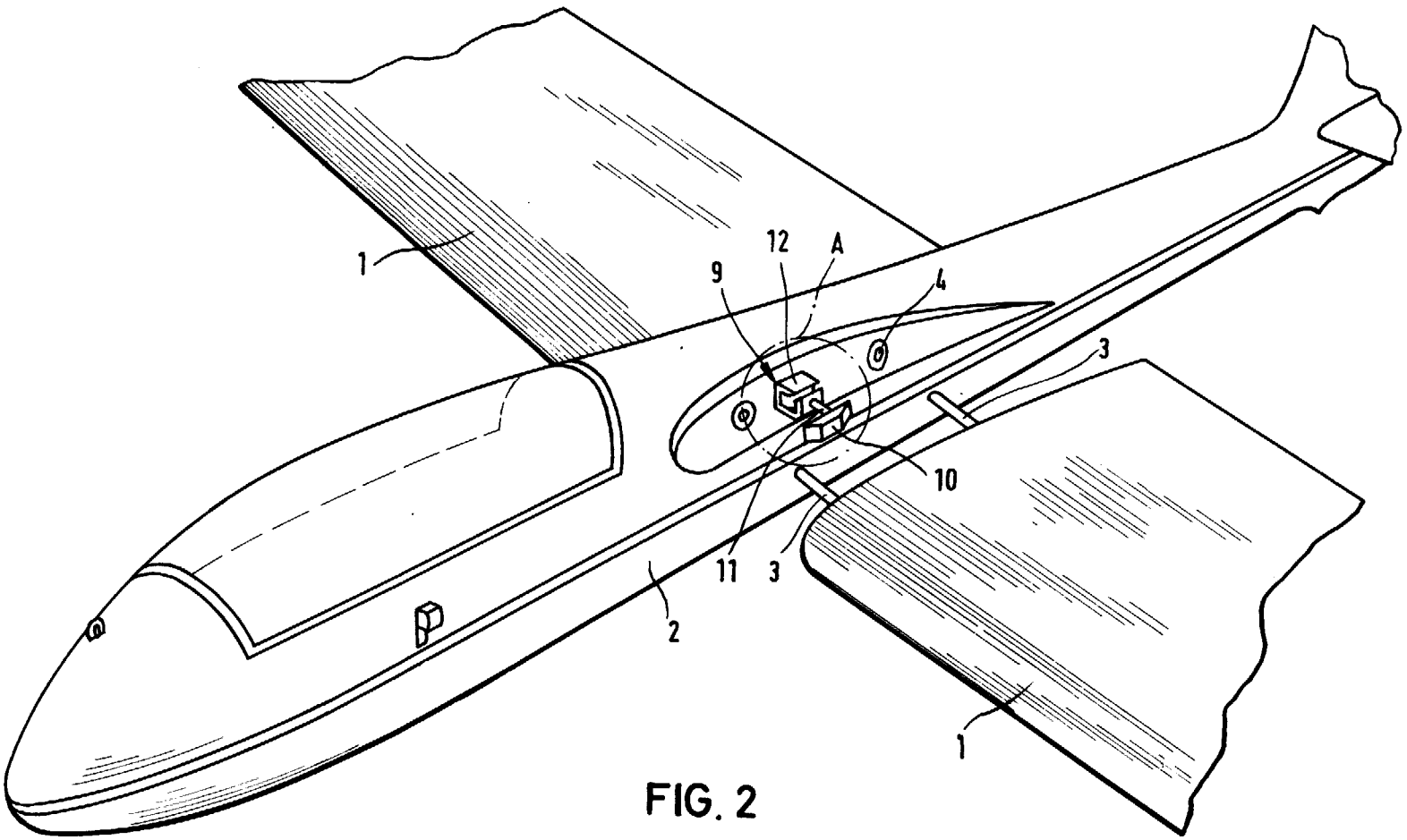
FIG. 2 is a perspective view, partly in section, of a model airplane in which the right-hand airplane wing has not yet been fastened to the fuselage.
Figure 3:
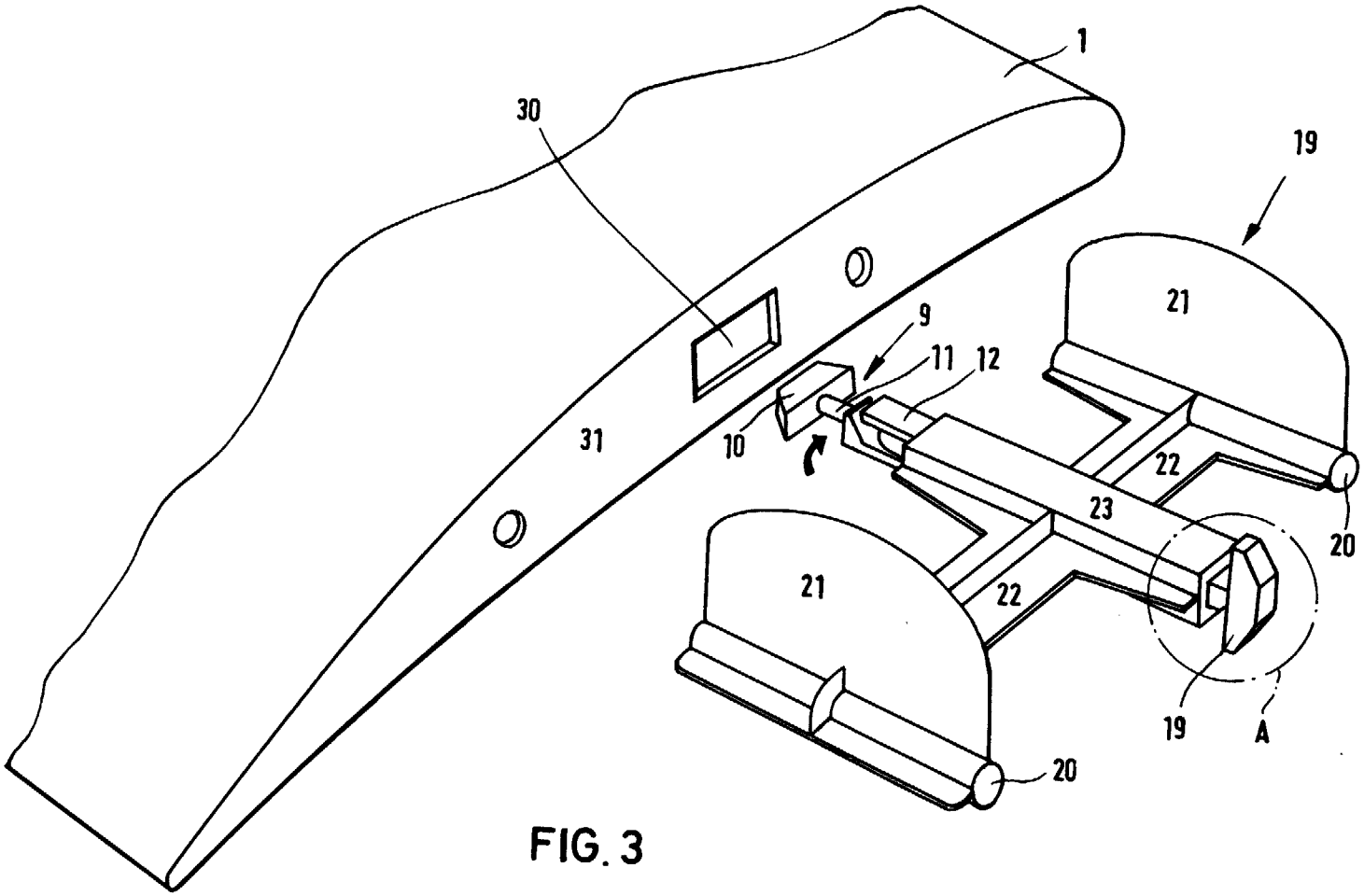
FIG. 3 illustrates, in a perspective schematic and exploded view, the end of an airplane wing and the component which supports the connector element within a fuselage.
Figure 4:
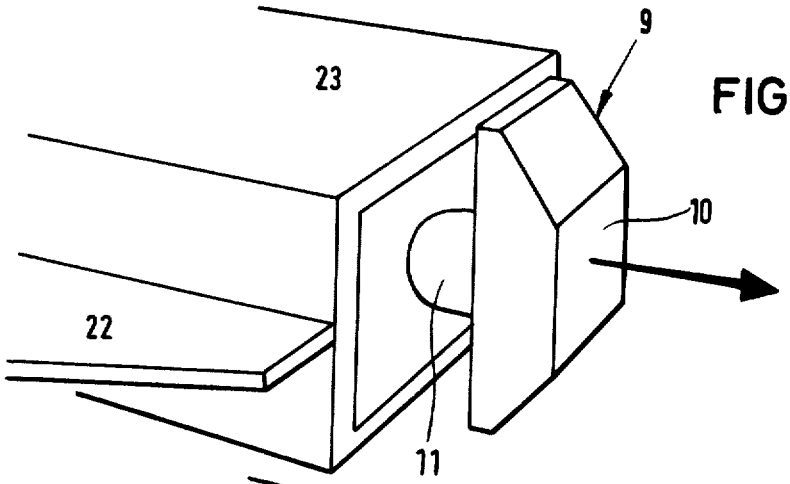
FIGS. 4 through 6 each, respectively, illustrate in enlarged perspective views details of the areas A shown in FIGS. 2 and 3.
Figure 5:
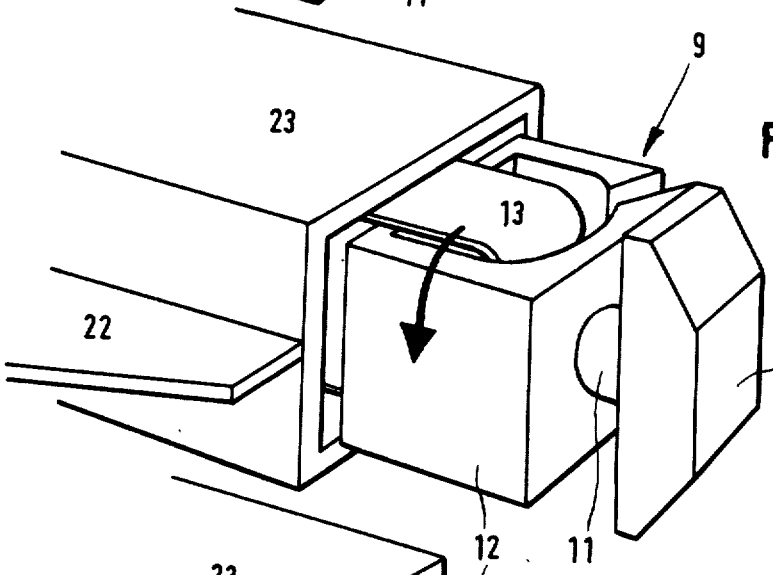
Figure 6:
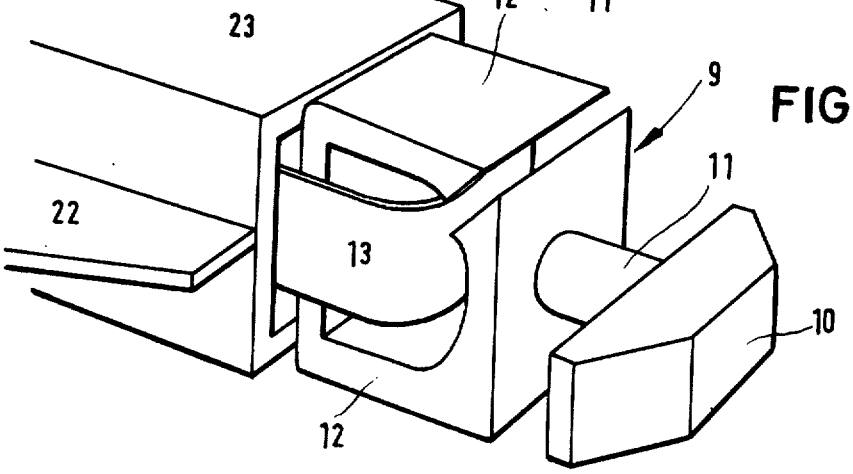

From FIGS. 2 through 6 there is more closely ascertainable the tongue and groove-like connector element 9. This element consists of tongue block 10 which may be essentially a truncated pyramid, the connector neck 11 and, located on the inner end thereof, a hook member 12. Hooked into the hook member 12 is the rubber band 13, the latter of which finds room in the constructional component 19 which is located within the fuselage 2 as shown in FIG. 3. This component 19 encompasses tubular element 20 for receiving the sleeves 4, respectively, the pins 3, partitions 21 which are used for stiffening the fuselage, and connector members 22 which provide connection with a hollow body 23 extending transversely within the fuselage. The hollow body 23 has a rectangular configuration in cross-section, and evidences at both its open ends the connector elements 9, the latter of which are connected by means of the rubber band 13 extending through the hollow body 23. The hook members 12 are so constructed so as to be able to enter into the hollow body 23 in a first position of the former (FIG. 4), however being unable to do so in a second position which is rotated through 90° (FIG. 6).

In order to produce the connection between the airplane wings 1 and the fuselage 2, the tongue and groove-like connector element 9 is withdrawn from the hollow body 23 and rotated by about 90° (FIGS. 2 and 3, left-hand). In this second position, the tongue and groove-like connector element 9 supports itself against the hollow member 23 by means of the hook member 12 under the pulling effect of the rubber band 13. After the introduction of the airplane wings, the tongue block 10 enters into the cutout 30 which is located in the end surface 31 of the airplane wing 1, and is then rotated or swivelled back through an angle of about 90°, either manually by means of a small tool (not shown). The hook member 12 of the tongue and groove-like connector element 9 hereby, by means of the rubber band 13, snaps into the hollow body 23 in the first position thereof, and thereby carries along the airplane wing 1 through the tongue block 10. In the illustrated embodiment (FIGS. 4 through 6), the tongue block 10 and the hook member 12 are generally rectangularly-shaped. Naturally, it is however also possible that other contours may be utilized therefore, with the exception of a circular cross-section. In each instance it must be noted that, upon swivelling or rotation, both elements provide for a cutting across over the outer element. In the above-described second position this leads to the support of the connector element 9 within the fuselage, and in the above-described first position leads to a locking of the tongue block 10 against the end surface of the airplane wing.

In the exemplary embodiment, a rubber band 13 is utilized for effecting the connection of the two tongue and groove-like connector elements. However, in a modification of the invention it is possible to utilize other elements in lieu thereof, such as for example, a spiral spring.

While there has been shown what is considered to be the preferred embodiment of the invention, it will be obvious that modifications may be made which come within the scope of the disclosure of the specification.

What is claimed is:

1. In a connector arrangement for the detachable fastening of airplane wings to the fuselages of model airplanes, including sleeves in said fuselages, and pins in said airplane wings adapted to be located in said sleeves for attaching said wings to said fuselages, the improvement comprising tongue and groove connector elements for pressing said wings against said fuselage; a rubber band imparting a tensile force to said connector elements, each said connector element being adapted to be pulled out and rotated into a second position in which said connector element is insertable into a complementary-shaped cut-out formed in the end surface of the airplane wing proximate thereto, and rotatable into a first position in which said airplane wing is maintained in engagement with said fuselage.

2. A connector arrangement as claimed in claim 1, said connector element being located interiorly of said fuselage in the first position thereof, and being supported against said fuselage in a withdrawn condition from said fuselage in the second position thereof at rotation through an angle of 90°, said connector element, in the first position thereof, being locked against rotation interiorly of said fuselage.

* * * * *